United States Patent [19]

Wurster et al.

[11] Patent Number: 4,580,199

[45] Date of Patent: Apr. 1, 1986

[54] DUAL FILAMENT HALOGEN CYCLE INCANDESCENT LAMP FOR THE USE IN MOTOR VEHICLE HEADLAMPS, FOR INSTANCE IN SEALED BEAM HEADLAMPS

[75] Inventors: Ewald Wurster, Grünwald; Manfred Gaugel, Fürstenfeldbruck, both of Fed. Rep. of Germany

[73] Assignee: Patent-Treuhand Gesellschaft fur Elektrische Gühlampen mbH, Munich, Fed. Rep. of Germany

[21] Appl. No.: 603,977

[22] Filed: Apr. 25, 1984

Related U.S. Application Data

[63] Continuation of Ser. No. 310,053, Oct. 9, 1981, abandoned.

[30] Foreign Application Priority Data

Nov. 3, 1980 [DE] Fed. Rep. of Germany ..... 3041397

[51] Int. Cl.[4] ..... F21M 3/30

[52] U.S. Cl. ..... 362/211; 362/247; 362/263; 362/296; 313/316; 315/64

[58] Field of Search ..... 362/61, 211, 263, 265, 362/267, 296, 235, 247; 313/222, 315, 264, 316; 315/64

[56] References Cited

U.S. PATENT DOCUMENTS

| | | | |
|---|---|---|---|
| 1,913,196 | 6/1933 | Falge et al. | 362/211 |
| 2,152,989 | 4/1939 | Ewest et al. | 362/263 |
| 2,784,336 | 3/1957 | Male | 315/64 |
| 3,940,606 | 2/1976 | Lemons | 362/263 |
| 4,140,939 | 2/1979 | Bonazoli | 313/316 |
| 4,302,698 | 11/1981 | Kiesel | 313/316 |
| 4,316,240 | 2/1982 | Pitkjaan et al. | 362/61 |

*Primary Examiner*—Craig R. Feinberg

*Attorney, Agent, or Firm*—Frishauf, Holtz, Goodman & Woodward

[57] ABSTRACT

The filaments for high beam and low beam are in respectively parallel planes, and the axis of the low beam filament forms an angle $\alpha$ which is less than 90° with the lamp axis, or seal beam headlamp axis, respectively, the angle being suitably between about 30° and 60°, and preferably about 45°, upon projection of the lamp axis, in parallel, in the plane which includes the axis of the filament. The inclination of the low beam filament facilitates adjustment of the headlamp to provide, reliably, glare-free road illumination in accordance with SAE standards.

6 Claims, 14 Drawing Figures

DUAL FILAMENT HALOGEN CYCLE INCANDESCENT LAMP FOR THE USE IN MOTOR VEHICLE HEADLAMPS, FOR INSTANCE IN SEALED BEAM HEADLAMPS

This application is a continuation of application Ser. No. 310,053, filed Oct. 9, 1981 now abandoned.

The invention relates to a dual filament halogen cycle incandescent lamp for installation in a reflector, to form a motor vehicle headlamp, for instance a sealed beam headlamp, comprising a filament for generating a lower beam and a filament for generating an upper beam having a light distribution in accordance with Society of Automotive Engineers (SAE) regulations, in which the filaments extend in planes that are parallel and offset relative to one another and are parallel to the lamp axis.

BACKGROUND

In known lamps of this type, each filament lies in a plane transverse to the lamp axis or to the optical axis of the headlamp, respectively. When superimposed on a measurement screen for correct adjustment of the lower beam and with the lamp placed at the prescribed distance from the motor vehicle, the images generated by the headlamp of the lower beam filament provide a luminous field having a high intensity zone in the right-hand lower quadrant of the measuring coordinates whose boundary between bright and dark is blurred at the coordinate side near the center or zero point. This makes it difficult to precisely adapt or adjust the luminous field in and to the left upper corner of the right-hand lower quadrant of the measuring coordinates during the correct lower beam adjustment of the headlamp. Glare has to be scrupulously avoided; intense radiation emitted in the area above the abscissa of the measuring coordinates must not be present. As far as possible, no radiation should fall on the left-hand lower quadrant of the measuring coordinates near the center or zero point.

THE INVENTION

It is an object to provide a lamp which, when installed in a generally parabolic reflector, at the coordinate side near the zero point, has an abrupt transition from bright to dark and in which the light gradient is steep so that glare to an oncoming viewer is reliably avoided.

Briefly, a dual filament halogen cycle incandescent lamp is provided in which the axis of the filament for the lower beam forms an angle $\alpha$ of less than 90°, and preferably between 30° and 60°, e.g. 45°, with a theoretical line or axis parallel to the lamp axis, or a reflector axis, respectively, and projected into the plane containing the lower beam filament axis.

DRAWINGS

FIG. 1 is a top view of a prior art standard known dual filament halogen cycle incandescent lamp for a motor vehicle;

FIG. *2a* is a top view of a first embodiment of the dual filament halogen cycle incandescent lamp for motor vehicle headlamps in accordance with the invention;

FIG. *2b* is a top view of a second embodiment;

FIG. *2c* shows the position of the axis of the lower beam filament of the lamp in accordance with the invention relative to the lamp axis or optical axis of the headlamp reflector, respectively;

Figure 12:
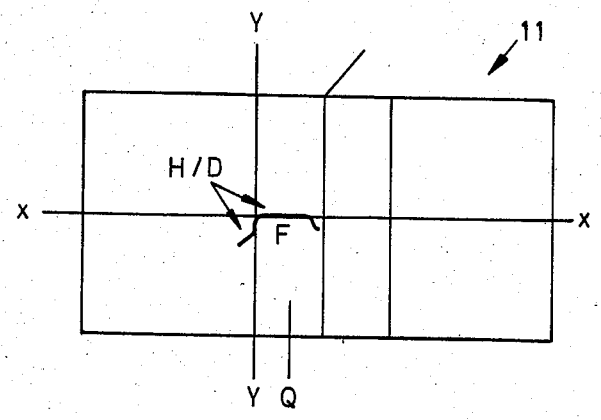
Figure 2C:
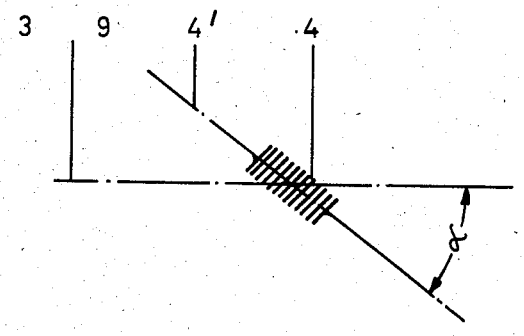
Figure 11:
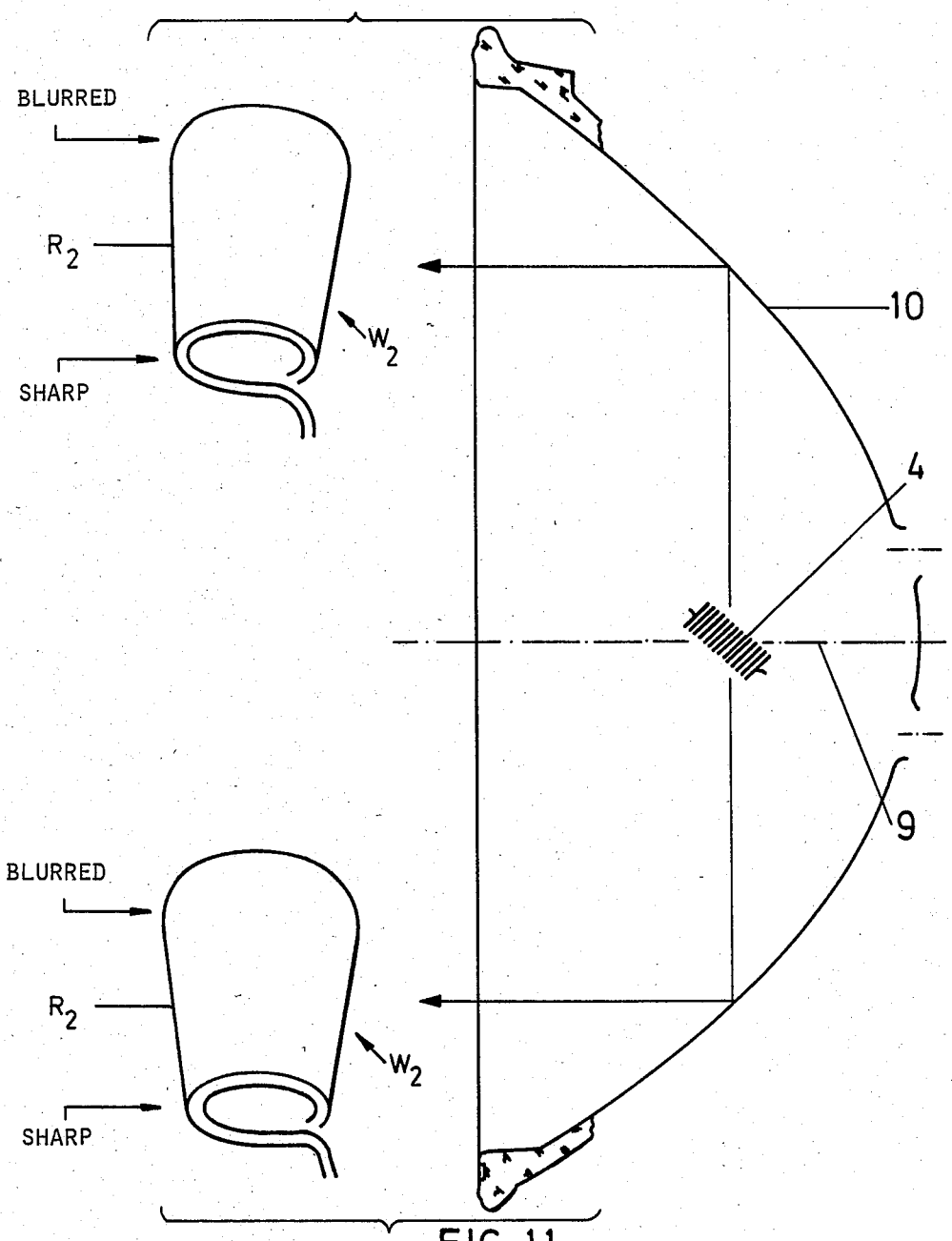

FIG. 11 shows the alignment of the lower beam filament of the lamps of FIGS. *2a*, *2b* relative to the optical axis of the headlamp reflector, and filament images generated by the latter; and FIG. 12 shows a measuring screen with measuring coordinates and with the luminous field generated by the lower beam filament of the lamp of the invention in the right-hand lower quadrant of the measuring coordinates.

Figure 3:
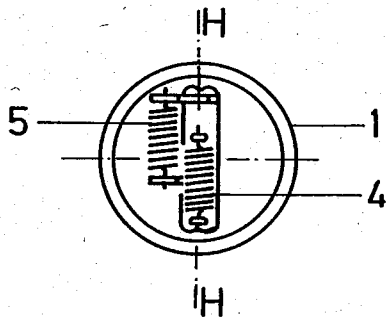
FIG. 3 PRIOR ART
FIGS. 3, 4, 5 are sections along lines A-B of the lamps of FIGS. 1, *2a*, and *2b* as seen from the bulb dome.
Figure 1:
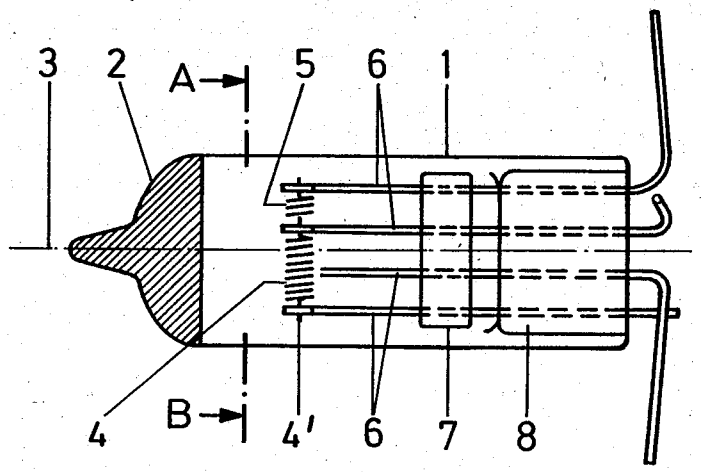
FIG. 1 PRIOR ART
Figure 4:
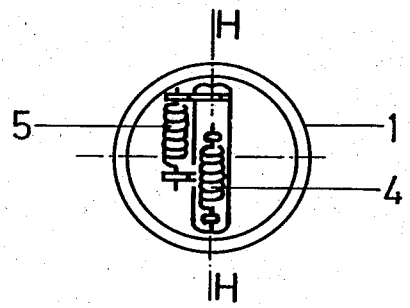
Figure 2A:
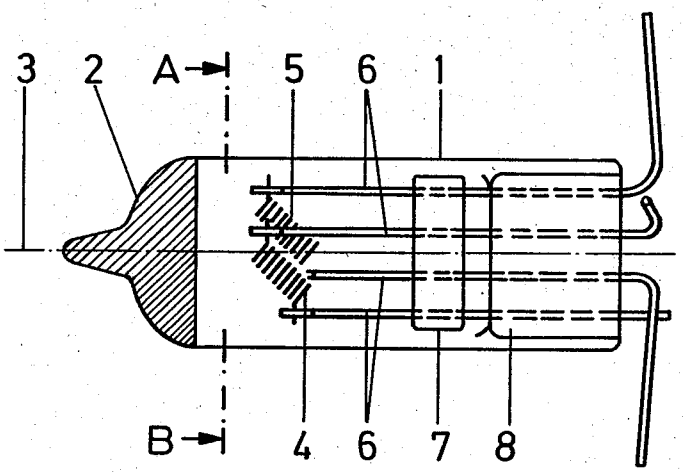
Figure 5:
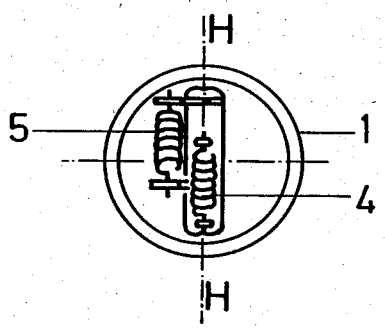
Figure 6:
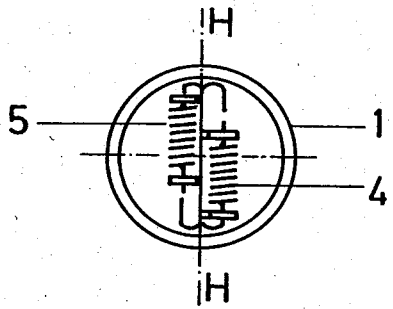
FIG. 6 is a section along lines A-B of FIG. *2a* and illustrating a further embodiment.
Figure 2B:
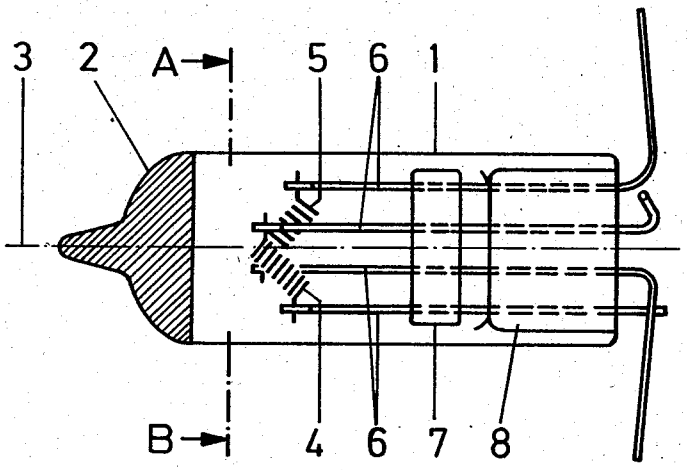

The lamps of FIGS. 1, *2a* and *2b* have a lamp envelope 1 which is, for instance, cylindrical. The lamps may comprise an opaque coating 2. Filaments 4, 5 which, as shown in the drawing, are unshielded, extend in planes which are parallel and offset relative to one another and parallel to the lamp axis 3. The filament 4 is the lower beam filament; the filament 5 is the upper beam filament. The filaments 4, 5 may be parallel or they may be rotated or skewed relative to one another; they may be positioned at the same height or at different heights of the lamp axis 3. They may be in a symmetrical position relative to the central plane H—H (FIG. 6) or they may be so shifted that the filament 4 lies in the central plane H—H (FIGS. 3, 4, 5).

Figure 7:
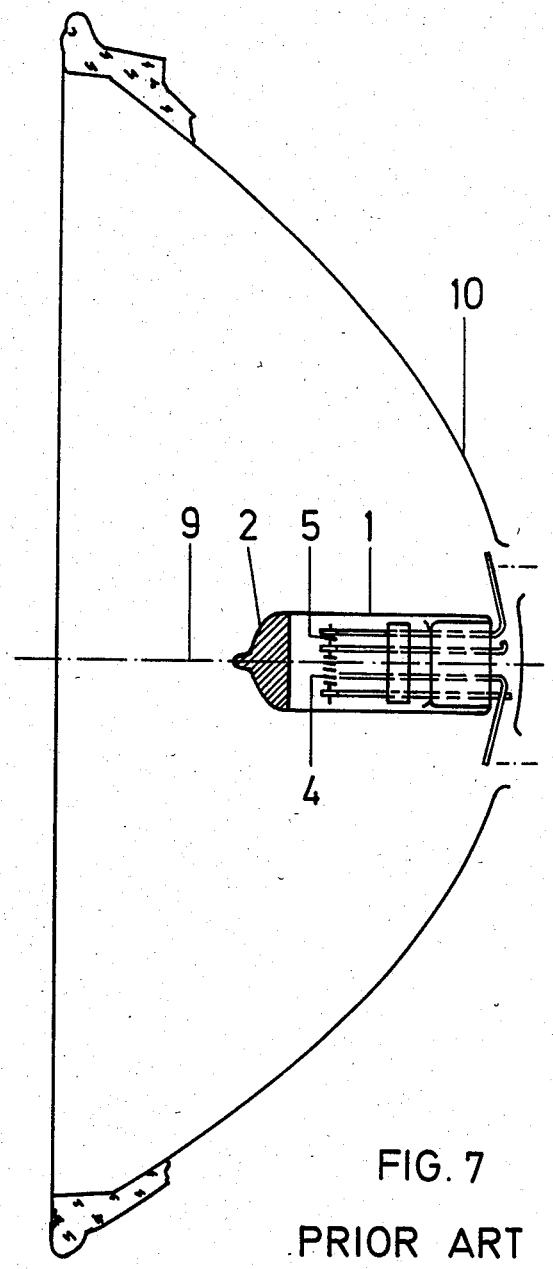
FIG. 7 PRIOR ART
FIG. 7 is a top view of a prior art lamp in a headlamp reflector shown in outline.
Figure 9:
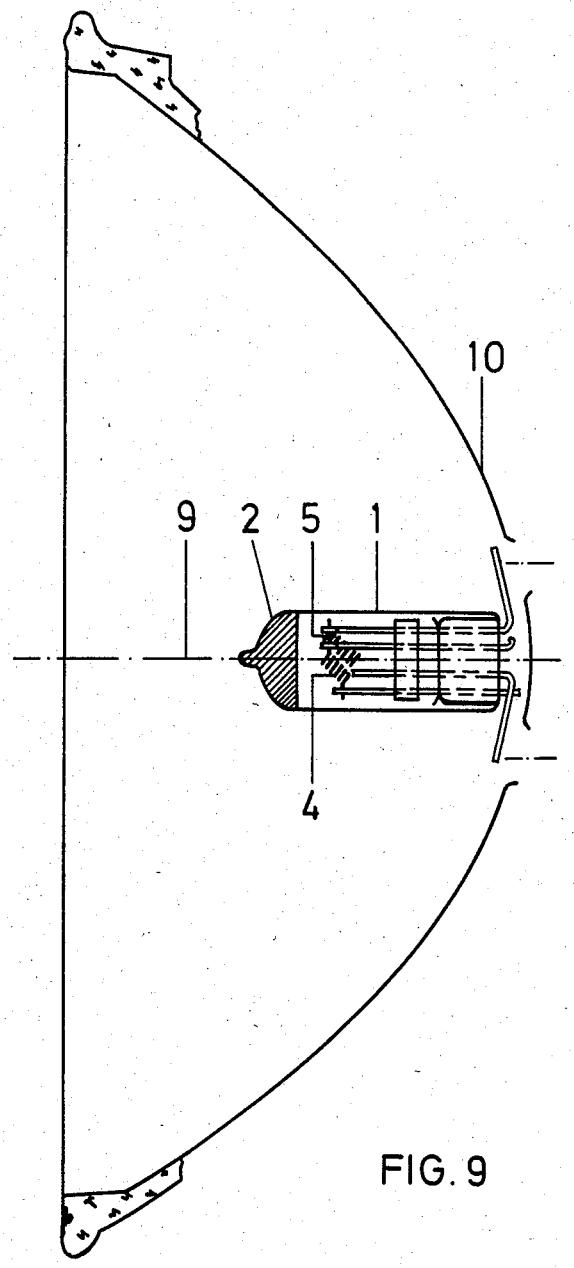
FIGS. 9, 10 are top views of the lamps of FIGS. *2a*, *2b* in a headlamp reflector shown in outline.
Figure 10:
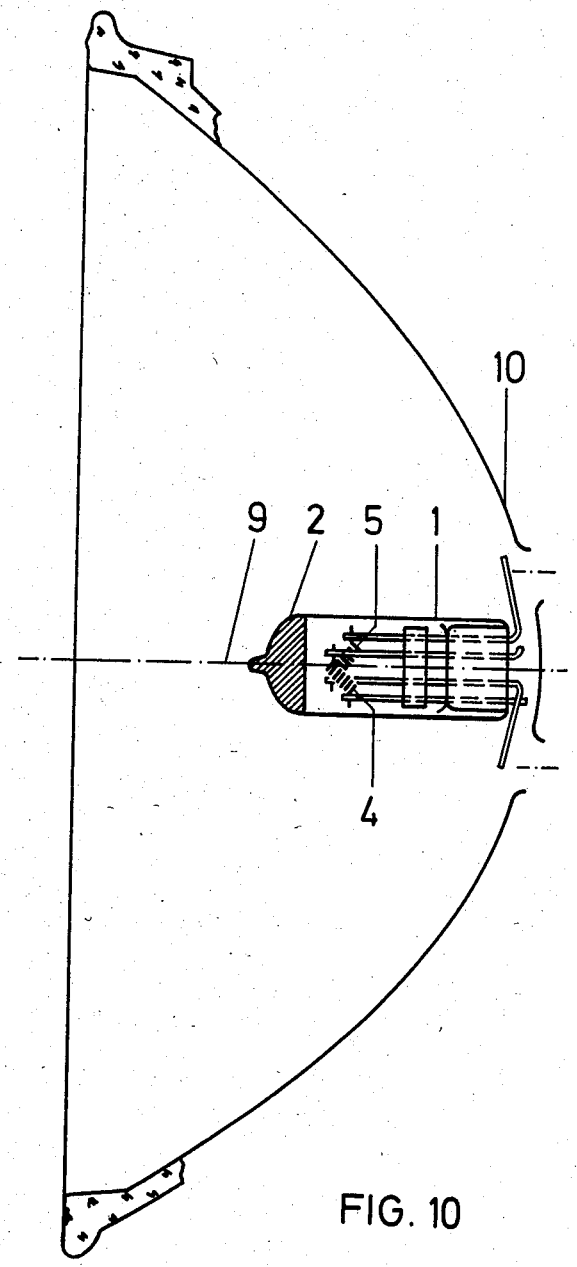

The filaments 4, 5 are supported by lead-in wires 6 of, for instance, molybdenum, which are passed through a seal 8 to the outside. A bridge 7 may be provided. In a lamp incorporated in a motor vehicle headlamp, for instance in a sealed beam headlamp, the lamp axis and the optical axis 9 of the headlamp reflector 10 point into a common direction (FIGS. 7, 9, 10) and are essentially parallel or even congruent. The filament spiral 4 of the known lamp lies transversely to the lamp axis 3 or to the optical axis 9 of the reflector 10, that is, the filament axis 4' and the lamp axis 3, or the optical axis 9 of the reflector 10, are relatively rotated through 90°.

Figure 8:
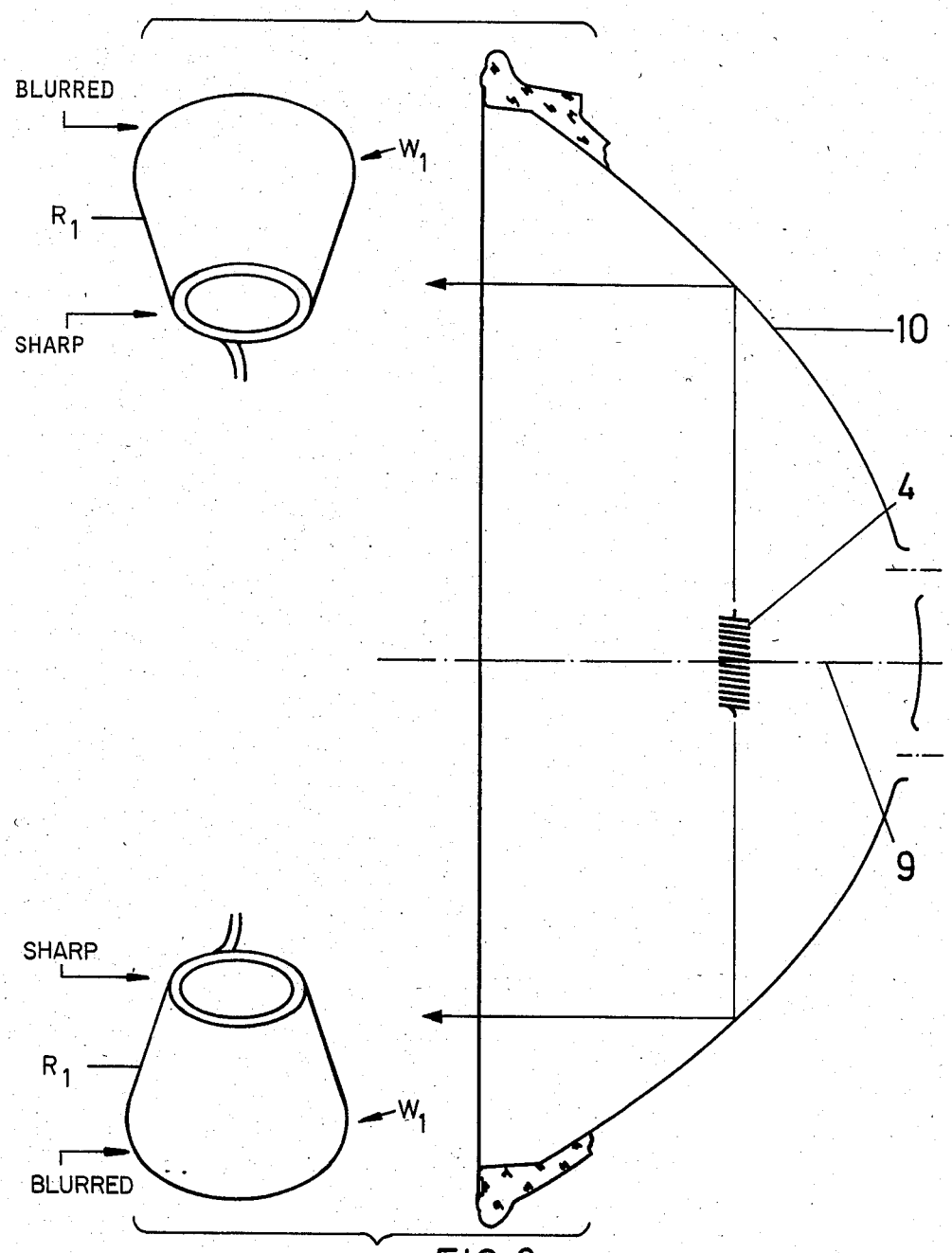
FIG. 8 PRIOR ART
FIG. 8 shows the alignment of the lower beam filament relative to the optical axis of a prior art headlamp reflector and filament images generated by the latter.

In accordance with the invention, filament 4 of the lamp is inclined with respect to the lamp axis 3 or to the optical axis 9 of the reflector 10, respectively. The coil axis 4' of this filament 4 for the lower beam forms with the lamp axis 3 or optical axis 9 of the headlamp reflector 10 (which has been, theoretically, projected in parallel into the plane containing the filament axis), an angle $\alpha$ in a range of between 30° and 60°. Preferably, $\alpha=45°$ (FIG. *2c*). With the 90°-transverse location of the lower beam filament of the known lamp, the headlamp reflector generates filament images $W_1$ on both sides of its optical axis as shown in FIG. 8. The filament images $W_2$ of the lower beam filament of the lamp in accordance with the invention are shown in FIG. 11. The—theoretical—projection of the lamp axis must be considered due to the offset of the filaments with respect to the lamp axis 3 or the optical axis 9 of reflector 10.

All the filament images are sharp in the region of the smallest image cross section and become blurred as the image cross section increases so that the image end $R_1$ or $R_2$ seems to be more and more blurred. The filament images of the filament of the known lamp are of a rounder, or ball, or bulged, or squat shape. The filament images of the filament of the lamp of the invention, when installed in reflector 10, rather take a slender conical tube shape. A substantial and marked difference between the filament images of FIG. 11 and those of FIG. 8 is the filament image with respect to the optical axis 9 of the headlamp reflector. In the prior art lamp—see FIG. 8—the images and sharpness of the transition are symmetrical. In the lamp of the invention—see FIG. 11—this symmetry is absent. The consequence is that, in practice, a superimposition of the filament images of FIG. 11 because of the inclined filament location will be different from the image of superimposition of the filament images of FIG. 8 of the transverse filament location. The lamp of the invention generates, on a measuring screen 11, arranged at the prescribed distance from the motor vehicle, a luminous field F in the right-hand lower quadrant Q of its measuring coordinates as shown in FIG. 12 whose boundary H/D between highlight or bright and dark is sharper on the coordinate side near the zero point. Thus, the adjustment of the correct lower beam may now be effected faster and more reliably to eliminate glare hazards.

We claim:

1. An automotive headlight comprising the combination a reflector (10) defining a reflector axis (9) with a dual filament halogen cycle incandescent lamp (1) defining a lamp axis (3), said lamp (1) having a coiled filament (5) for generating an upper beam;

a coiled filament (4) for generating a lower beam and defining a lower beam coil axis, in which the filaments (4, 5) are positioned in planes which are parallel and offset relative to one another and at least approximately in line with the reflector axis (9), and including, in accordance with the invention, a filament arrangement means for the distribution of light emitted from the reflector, upon energization of the lower beam filament (4) is non-symmetrical about a plane extending along said reflector axis intersecting said lower beam coil axis and forms a sharp transition zone between a substantially straight illuminated area and a surrounding dark area when impinging on a surface normal to the emitted light, wherein the coil axis of the lower beam filament (4) forms an angle ($\alpha$) of between about 30° and 60° with a theoretical axis parallel to the lamp axis (3) and projected into the plane containing the coil axis (4) of the lower beam filament.

2. Automotive headlight according to claim 1, wherein the angle ($\alpha$) is 45°.

3. Automotive headlight according to claim 1, wherein the lamp axis (3) and the reflector axis (9) are essentially parallel.

4. Automotive headlight according to claim 1, wherein the angle ($\alpha$) is 45°;

and the lamp axis (3) and the reflector axis (9) are essentially parallel.

5. A sealed beam automotive headlight comprising:

a dual filament halogen cycle incandescent lamp-reflector combination, wherein the reflector defines a reflector axis (9);

wherein said lamp defines a lamp axis (3) and comprises a coiled filament (5) for generating an upper beam;

a coiled filament (4) for generating a lower beam and defining a coil axis;

wherein the lamp axis (3) and the reflector axis (9) are essentially parallel, and the filaments (4, 5) of the lamp are positioned in planes which are parallel and offset relative to one another and at least approximately in line with the axis (9) of the reflector (10);

a filament arrangement means for the distribution of light emitted from the reflector, upon energization of the lower beam filament (4) is non-symmetrical about a plane extending along said reflector axis intersecting said lower beam coil axis and forms a sharp transition zone between a substantially straight illuminated area and a surrounding dark area when impinging on a surface normal to the emitted light, wherein the coil axis of the lower beam filament (4) forms an angle ($\alpha$) of between about 30° and 60° with a theoretical axis parallel to the lamp axis (3) and hence with the reflector axis (9) and projected into the plane containing the coil axis of the lower beam filament.

6. An automotive headlight according to claim 5, wherein said angle ($\alpha$) is 45°.

* * * * *